US005950555A

United States Patent [19]

Damask

[11] Patent Number: 5,950,555

[45] Date of Patent: Sep. 14, 1999

[54] BILGE PUMP FOR A PERSONAL WATERCRAFT

[76] Inventor: Douglas M. Damask, 6925 Ashwood Rd. Apt. 304, Woodbury, Minn. 55125

[21] Appl. No.: 08/938,182

[22] Filed: Sep. 26, 1997

[51] Int. Cl.[6] ..... B63B 13/00

[52] U.S. Cl. ..... 114/183 R; 114/347; 417/550

[58] Field of Search ..... 114/183 R, 183 A, 114/347; 417/550, 551.1

[56] References Cited

U.S. PATENT DOCUMENTS

| | | | |
|---|---|---|---|
| 210,055 | 11/1878 | Sanders . | |
| 2,173,207 | 9/1939 | Larsson | 103/153 |
| 2,547,431 | 4/1951 | Anderson | 114/184 |
| 2,777,397 | 1/1957 | Atkinson | 103/148 |
| 3,006,282 | 10/1961 | Sisson | 417/555.1 |
| 3,051,967 | 9/1962 | Beach | 114/361 |
| 3,843,983 | 10/1974 | Tangen | 9/2 A |
| 3,904,325 | 9/1975 | Olofsson et al. | 417/512 |
| 4,326,478 | 4/1982 | Holmes | 114/183 R |
| 4,838,196 | 6/1989 | Ingram | 114/347 |
| 4,907,997 | 3/1990 | Hall | 114/345 |
| 5,163,778 | 11/1992 | Botero | 440/101 |
| 5,542,369 | 8/1996 | Ingram | 114/347 |

*Primary Examiner*—Sherman Basinger
*Attorney, Agent, or Firm*—Westman, Champlin & Kelly, P. A .; S. Koehler

[57] ABSTRACT

A bilge pump for removing water from a personal watercraft such as a kayak or a decked canoe that has a hull and a deck attached to the hull forming a cockpit opening for an operator includes a pumping device secured within the hull and below the deck. A pickup is also located within the hull and is fluidly coupled to the pumping device. An operating handle is positioned proximate the cockpit opening and is coupled to the pumping device to operate the pumping device.

23 Claims, 6 Drawing Sheets

BILGE PUMP FOR A PERSONAL WATERCRAFT

BACKGROUND OF THE INVENTION

The present invention relates to a personal watercraft such as a kayak or a decked canoe having a cockpit opening through which an operator extends when operating the personal watercraft. In particular, the present invention is a bilge pump to discharge water collected in the personal watercraft.

A personal watercraft such as a kayak or a decked canoe is a small, lightweight boat that can be easily maneuvered in rough water such as in rivers or in oceans. The kayak or decked canoe includes a hull and an upper deck attached to the hull. A cockpit opening is provided in the upper deck. An operator sits within the hull and extends through the cockpit opening during operation. This type of watercraft sits very low in the water and is susceptible to water entering the hull, particularly when the kayak or decked canoe travels through or slides down a large wave. Commonly, a flexible skirt is attached to the upper deck about the perimeter of the cockpit opening. The flexible skirt forms a smaller aperture through which the operator can extend. The flexible skirt tries to maintain a seal around the operator so that water does not enter the hull through the cockpit opening.

Those who have used kayaks know that although the flexible skirt does prevent at least some water from entering the hull, water still manages to collect within the hull of the kayak or decked canoe during normal operation. Some prior techniques for removing the water that has collected in the hull include using a portable, hand held pump to discharge the water from the kayak or decked canoe, or use of a sponge to soak up the water, which is then rung out. However, it is often necessary for the operator to paddle to shore in order to exit the kayak or decked canoe to use the hand pump or the sponge.

There is an ongoing need to provide a simpler method for discharging water from a watercraft such as a kayak or decked canoe that does not require the operator to exit the watercraft.

SUMMARY OF THE INVENTION

A bilge pump for removing water from a personal watercraft such as a kayak or a decked canoe that has a hull and a deck attached to the hull forming a cockpit opening for an operator includes a pumping device secured within the hull and below the deck. A pickup is also locatable within the hull and is fluidly coupled to the pumping device. An operating handle is positioned proximate the cockpit opening and is coupled to the pumping device to operate the pumping device.

In a preferred embodiment, the pumping device includes a housing forming a chamber for holding water and a piston displaceable within the chamber to pump water through the passageway. The piston is connected to the operating handle for movement therewith. In order to pump water from the hull, the operating handle is moved upwardly and downwardly with respect to the deck. When not in use, the operating handle retracts within the housing and at least partially within the hull so that an end of the operating handle grasped by the operator is positioned substantially adjacent to or below the deck. A first locking device such as engaging flanges formed on the end is used to hold the operating handle in a retracted position. In a further embodiment, a second locking device further secures the handle in the retracted position.

DETAILED DESCRIPTION OF THE PREFERRED EMBODIMENTS

Figure 1:
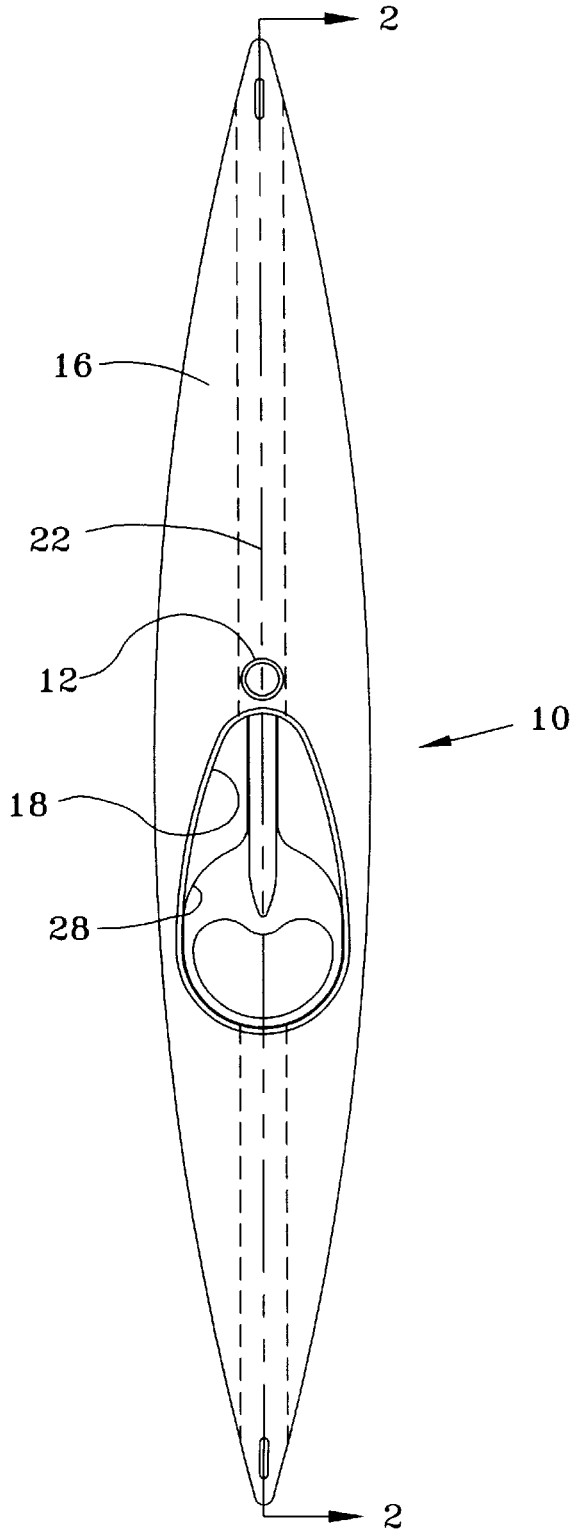
FIG. 1 is a top plan view of a kayak.
Figure 2:
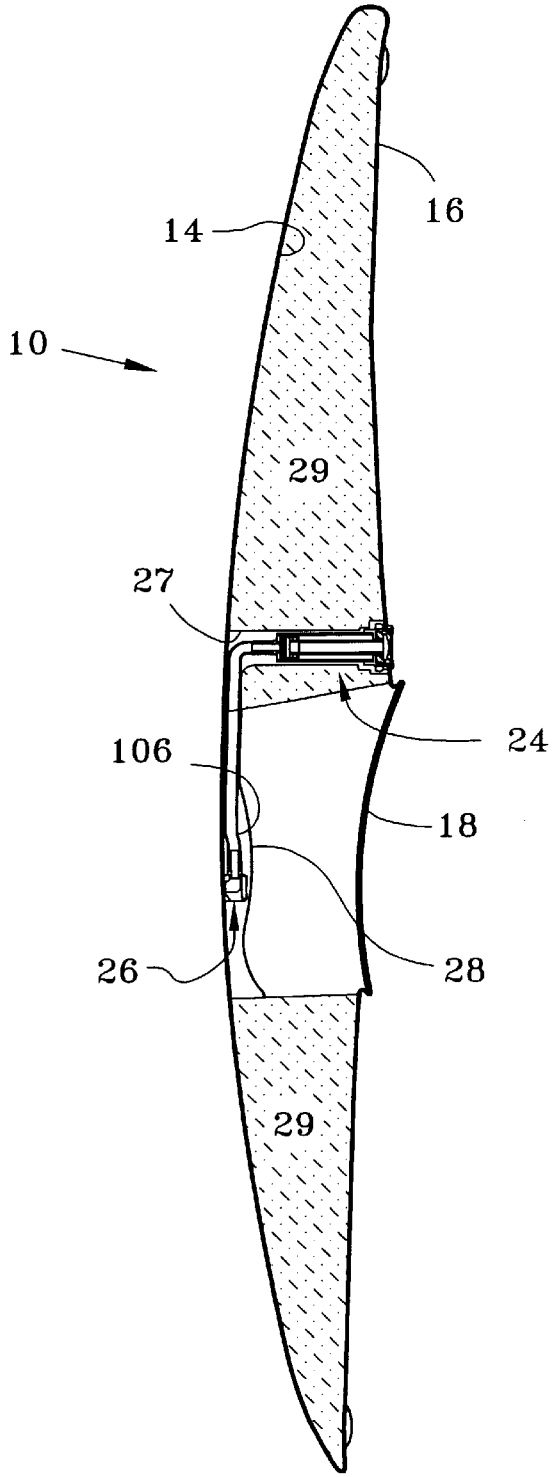
FIG. 2 is a sectional view of the kayak taken along lines 2—2 of FIG. 1.

FIGS. 1 and 2 illustrate a personal watercraft 10 having a bilge pump 12 according to the present invention. Embodied herein, the personal watercraft 10 is a kayak having a hull 14 and deck 16 attached thereto. The deck 16 includes a cockpit opening 18 through which an operator extends during operation of the kayak 10. Although embodied herein as a kayak, the present invention is not limited to only kayaks, but rather, can be used with other forms of personal watercraft that have the hull 14, the deck 16 and the cockpit opening 18, such as a decked canoe.

The bilge pump 12 provides a convenient and easy to use apparatus for discharging water that has collected within the hull 14. As illustrated, the bilge pump 12 is secured within the hull 14, such as to the deck 16, and is preferably positioned forward of and proximate to the cockpit opening 18. As used herein with respect to the position of the bilge pump 12, "proximate" shall mean within arm's length of the cockpit opening 18 so that the operator can easily reach and operate the bilge pump 12 while seated in the kayak 10. Although illustrated wherein the bilge pump 12 has been positioned on a center line 22 of the kayak 10, as appreciated by those skilled in the art, the bilge pump 12 can be located off the center line 22, yet still within arm's length of the cockpit opening 18.

Figure 3:
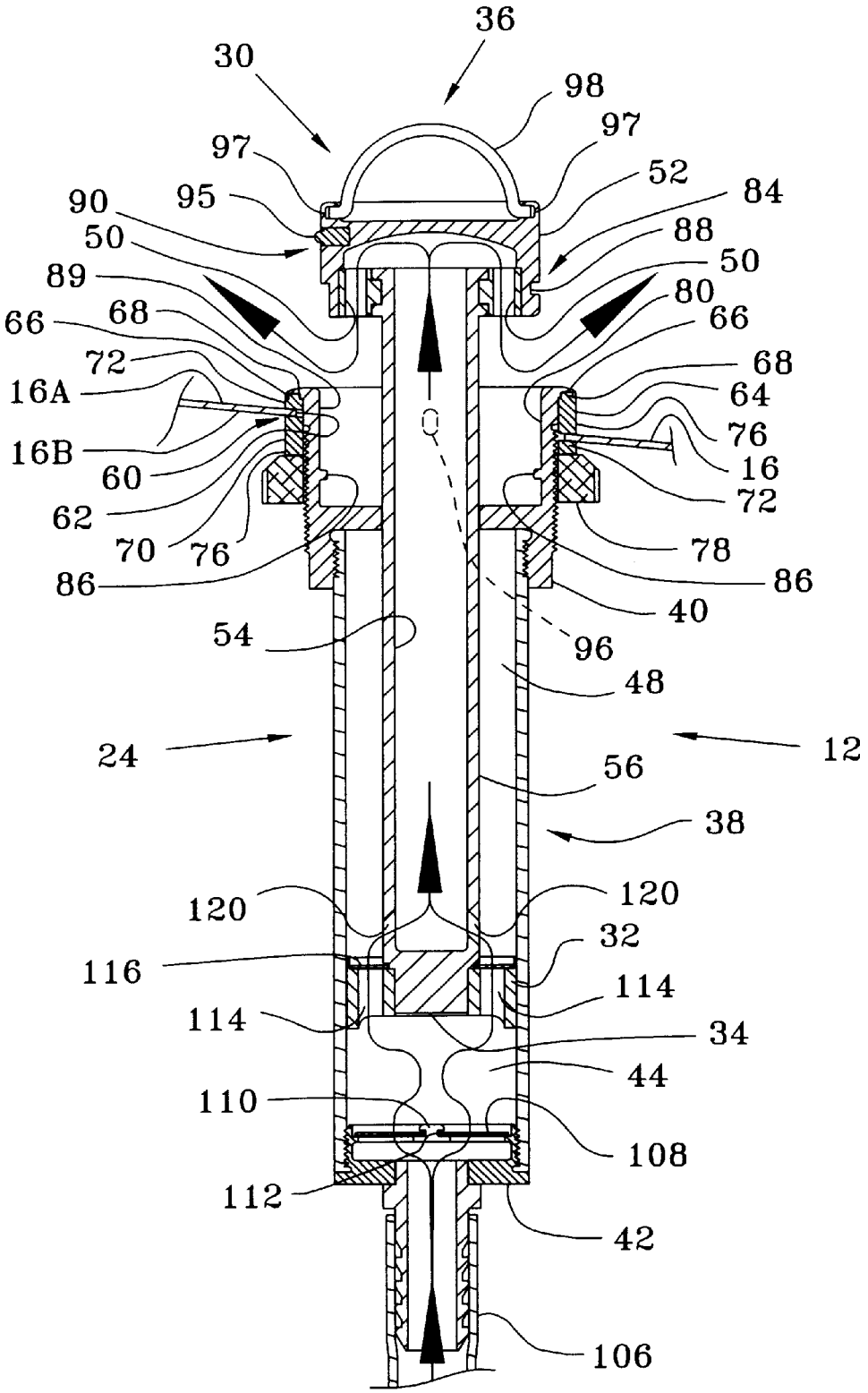
FIG. 3 is a sectional view of a pumping device.
Figure 4:
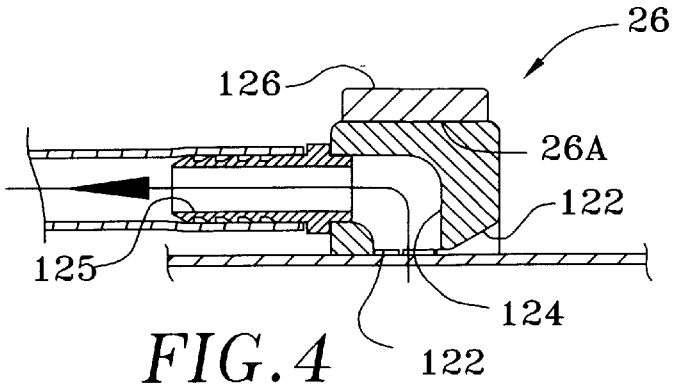
FIG. 4 is a sectional view of the pickup device.

Referring also to FIGS. 3 and 4, the bilge pump 12 includes a pumping device 24 secured within the hull 14 below the deck 16. In the embodiment illustrated, the pumping device 24 is located in a cavity 27 formed in a center foam pillar 29 provided in the kayak 10. The pumping device 24 is fluidly coupled to a water pickup or inlet 26. The pickup 26 is located in the hull 14 at a position where water collects during operation of the kayak 10. Typically, this position is just below a seat 28 for the operator.

Figure 5:
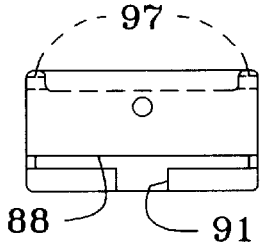
FIG. 5 is a side elevational view of a grip.
Figure 7:
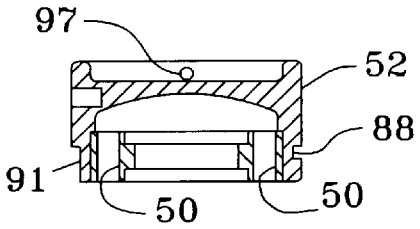
FIG. 7 is a sectional view of the grip taken along lines 7—7 of FIG. 6.
Figure 6:
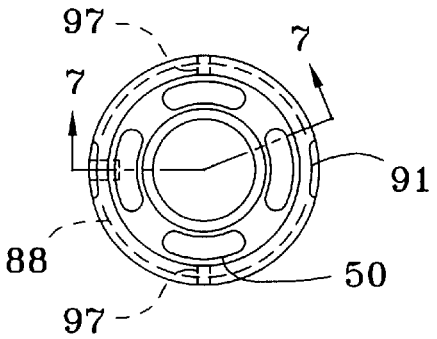
FIG. 6 is a bottom plan view of the grip.

In a preferred embodiment, the bilge pump 12 includes an operating handle 30 that can retract within the hull 14 at least partially below the deck 16. In the embodiment illustrated, a piston 32 is secured to the operating handle 30 at an end 34 remote from an end 36, which is grasped by the operator. The piston 32 is moveable in a housing 38. The housing 38 includes an upper end cap 40 and a lower end cap 42. A lower chamber 44 and an upper chamber 48 formed on opposite sides of the piston 32 vary in volume as the piston 32 slides within the housing 38 in order to collect water from the pickup device 26 and discharge it from the hull 14. The end 36 includes a discharge port 50 formed in a grip 52, that is also illustrated in FIGS. 5, 6 and 7. The discharge port 50 is fluidly coupled to a passageway 54 formed in a connecting rod 56. The connecting rod 56 joins the grip 52 to the piston 32. In the embodiment illustrated, the grip 52 can spin on the connecting rod 56, while the connecting rod is secured in a fixed position to the piston 32.

In the embodiment as illustrated in FIG. 2, the housing 38 is of sufficient length such that the operating handle 30 can be retracted within the hull 14 to a position where the end 36 of the operating handle 30 is substantially level with, or below, the deck 16 so as not to form a large upstanding obstruction, particularly when it is inverted in the water. In one embodiment, the end 36 of the operating handle 30 does not extend approximately more than three inches beyond the deck 16 in the retracted position. In a preferred embodiment, the end 36 of the operating handle 30 does not extend approximately more than one inch beyond the deck 16 in a retracted position, while in a further preferred embodiment the end 36 of the handle does not extend approximately more than one-half of an inch beyond the deck 16.

An adapter assembly 60 mounts the pumping device 24 to the deck 16 and, preferably, conforms generally to the shape thereof. As illustrated, the upper end cap 40 extends through an aperture 62 provided in the deck 16. The adapter assembly 60 includes an upper adapter ring 64 that engages an upper surface 16A of the deck 16 about the aperture 62. The upper adapter ring 64 includes pins 66 that cooperate with recesses 68 formed on the upper end cap 40. The pins 66 and the recesses 68 help retain upper adapter ring 64 in position. A lower adapter ring 70 engages a lower surface 16B of the deck 16. The upper adapter ring 64 and the lower adapter ring 70 are of size and shape so as to conform to the deck 16 and retain the bilge pump 12 in a generally upright position. The upper adapter ring 64 and the lower adapter ring 70 each include a portion 72 of smaller width and a portion 76 of larger width, which allow the upper and lower adapter rings 64 and 70 to be orientated relative to each other to conform to the upper surface 16A of the deck 16. A locking ring 78 mates with the upper end cap 40 using, for example, threads as illustrated, to hold the upper and lower adapter rings 64 and 70 in engagement with the deck 16 and the upper end cap 40.

Figure 11:
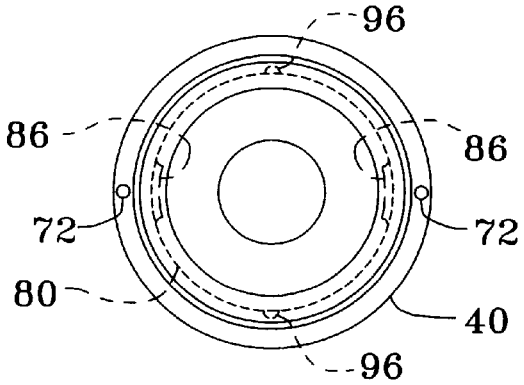
FIG. 11 is a bottom plan view of an upper end cap.

In one embodiment, the grip 52 is received within a recess 80 provided in the upper end cap 40. The recess 80 allows the end 36 of the operating handle 30 and, in particular, the grip 52 to assume a position that is relatively low with respect to the deck 16. A locking device generally indicated at 84 retains the member 52 within the recess 80 so that the operating handle 30 does not inadvertently extend significantly above the deck 16. The locking device 84 can take many forms. In the embodiment illustrated, the locking device 84 comprises extending flanges 86 formed on an inner wall 89 of the recess 80 that cooperates with a groove 88 formed in the grip 52. As illustrated in FIG. 11, the flanges 86 only partially extend within the inner circumference of the recess 80 so that the flanges 86 will only engage the groove 88 upon rotation of the grip 52 to selected positions. Enlarged portions 91 of the groove 88 are of size to allow the flanges 86 to fit therein (FIG. 6).

In the preferred embodiment, a second locking device 90 is also used to retain the operating handle 30 in a retracted position. Embodied herein as a detent mechanism, the second locking device 90 includes a detent pin 95, which selectively engages suitable recesses 96 (FIG. 11) formed in the upper end cap 40 when the grip 52 has been placed in a locked position when the flanges 86 have engaged the groove 88. Other alternative locking devices for the first locking device 84 and the second locking device 90 include engaging threads formed on the grip 52 and the upper end cap 40, or suitable catches formed therebetween. A bail 98 is secured in apertures 97 to the grip 52 to allow convenient rotation.

Figure 8:
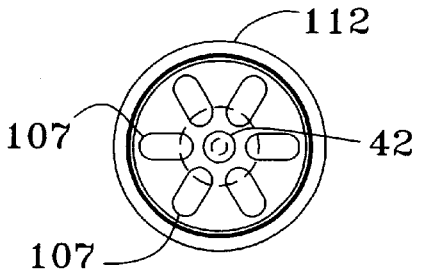
FIG. 8 is a bottom plan view of a lower end cap.

Referring to FIG. 3, the bilge pump 12 is operated as follows. The operator grasps the bail 98 and turns the grip 52 clockwise or counter-clockwise to disengage the detent pin 95 from the recess 96 and to disengage the flanges 86 from the groove 88 in order to release the grip 52 from the upper end cap 40. Upward lifting of the operating handle 30 moves the piston 32 away from the lower end cap 42 to create a vacuum in the lower chamber 44 to draw water from the pickup device 26 through a coupling hose 106, through apertures 107 in the lower end cap 42 and by a reed valve 108 provided on the lower end cap 42. In the embodiment illustrated, the reed valve 108 comprises a flat disk flexible washer. Referring also to FIG. 8, a center boss 110 provided in the lower end cap 42 projects through a center aperture 112 provided in the washer 108 to hold it in place.

Figure 9:
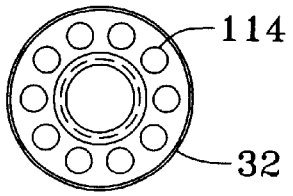
FIG. 9 is a bottom plan view of a piston.

When the operator pushes down on the operating handle 30 to move the piston 32 toward the lower end cap 42, the washer 108 seals against the lower end cap 42. Water is then transferred from the lower chamber 44 to the upper chamber 108 through the piston 32 via passageways 114 (FIG. 9) provided therein and by a second reed valve 116. Some water may also enter the passageway 54 provided in the operating handle 30 through apertures 120. When the operating handle 30 is subsequently lifted again upwardly, water in the upper chamber 48 is forced upwardly into and through the passageway 54 and out the discharge ports 50 in the grip 52. Simultaneously, as described above, water enters the lower chamber 44 from the pickup device 26.

Figure 10:
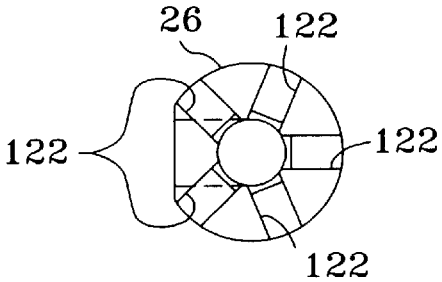
FIG. 10 is a bottom plan view of the pickup device.

The pickup device 26 is illustrated in FIGS. 4 and 10. The pickup device 26 includes suitable recesses 122 allowing water to enter an inlet opening 124. A hose coupler 125 joins the pickup device 26 to the coupling hose 106. In one embodiment, a compliant pad 126 is provided on an upper surface 26A of the pickup device 26 and is disposed between the pickup device 26 and the seat 28 (FIG. 2) in order to keep the pickup device 26 in place against the inner wall of the hull 14. The compliant pad 26 can be, for example, foam and is used since the seat 28 and the hull 14 flex. If desired, the pickup device 26 can be rigidly attached or formed as part of the hull 14.

Figure 12:
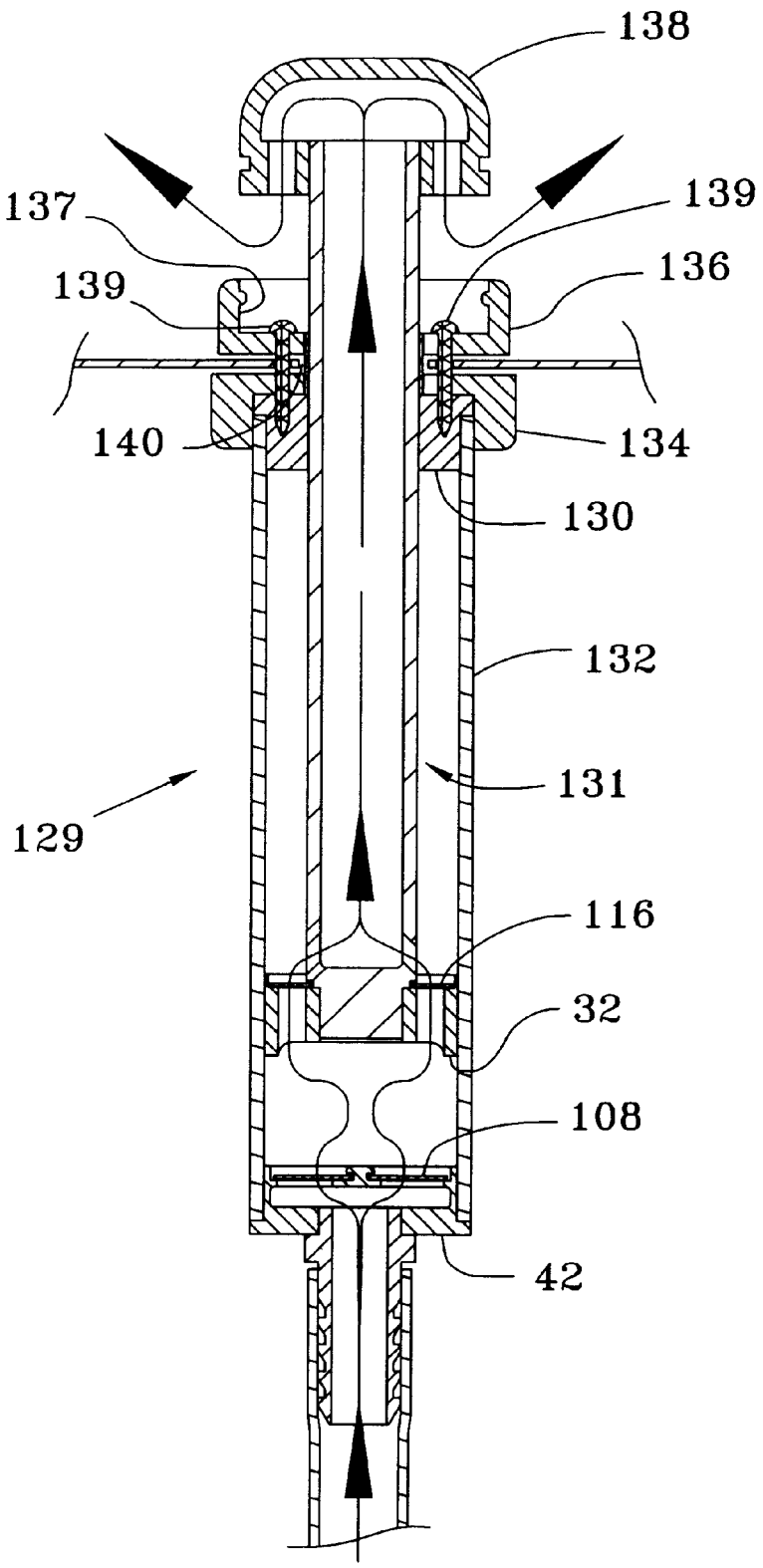
FIG. 12 is a sectional view of a second pumping device.

FIG. 12 illustrates an alternative mounting arrangement for a bilge pump 129. In this embodiment, an end cap 136 allows retraction of an operating handle 131 into an outer housing 132. A lower mounting plate 134 extends over the end cap 130 and is located below the deck 16. An upper mounting plate 136 is disposed above the deck 16 and includes a recess 137 for receiving a grip 138. Fasteners, such as screws 139, extend through the upper mounting plate 136, the deck 16, the lower mounting plate 134 and are secured into the end cap 130 to clamp the deck 16 between the lower mounting plate 134 and the upper mounting plate 136. The embodiment may be advantageous since a smaller aperture 140 can be used instead of the aperture 162 formed in the deck 16 of the previous embodiment.

Figure 15:
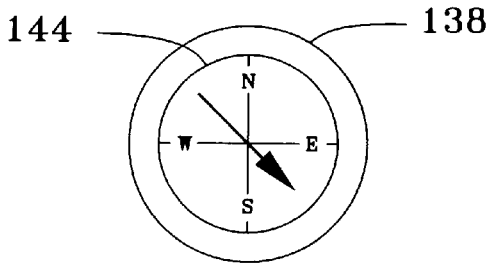
FIG. 15 is a top plan view of a grip.

Referring also to FIG. 15, a compass 144 can be mounted in or otherwise disposed on the grip 138. The compass 144 aids the operator in navigation of the kayak 10 and is conveniently positioned in front of the operator, particularly when the operating handle 131 is in a retracted position. The compass 144 can be used on any of the grips herein described.

Figure 14:
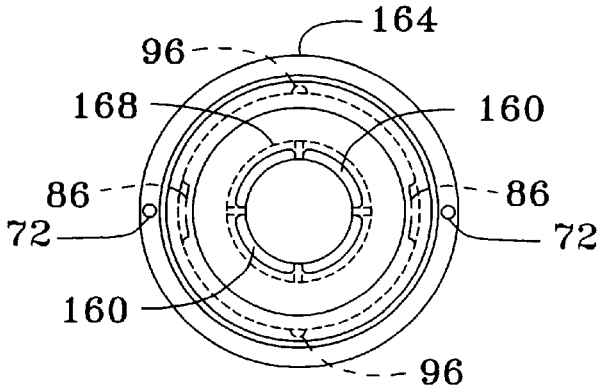
FIG. 14 is a bottom plan view of an upper end cap for the pumping device of FIG. 13.
Figure 13:
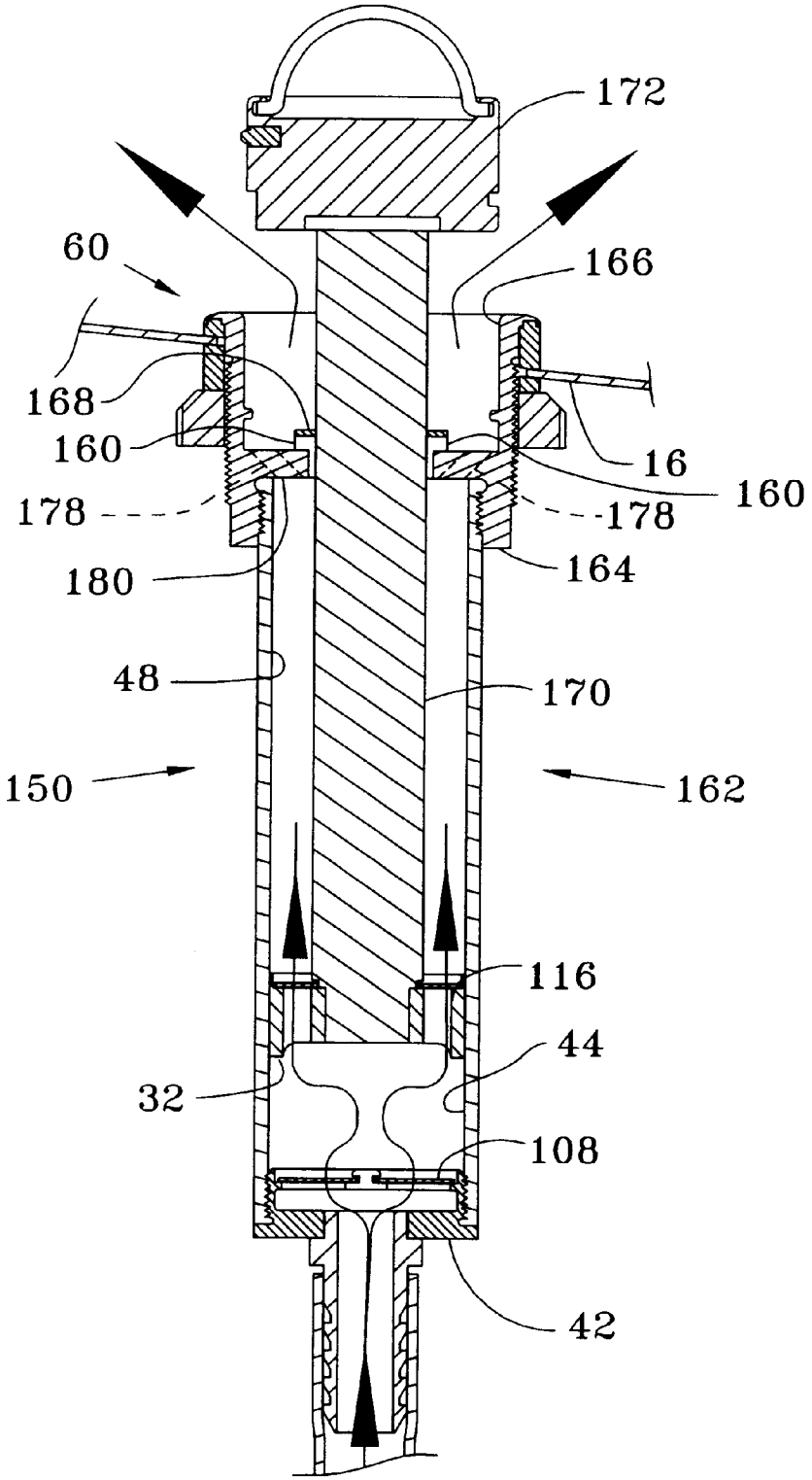
FIG. 13 is a sectional view of a third pumping device.

FIGS. 13 and 14 illustrates an alternative pumping device 150. Unlike the previous embodiments where water from the hull 14 is discharged onto the deck 16 through apertures 50 provided in the operating handle 30, in this embodiment, water is discharged from the upper chamber 48 through discharge openings 160 provided in a housing 162 of the pumping device 150. In the particular embodiment illustrated, the discharge openings 160 are formed in an end cap 164 that is otherwise similar to the upper end cap 40 described above. The discharge openings 160 open toward an inner wall 166 so as to reduce spray. The end cap 164 includes a deflector 168 forming the discharge openings 160. The discharge openings 160 and the deflector 168 are positioned about a connecting rod 170. In another embodiment, discharge openings 178 can be provided in an end wall 180. A suitable valve, such as a reed valve, can be used to ensure one way flow through the discharge openings 160 and 178, if desired. The pumping device 150 may be preferred since the connecting rod 170 and a grip 172 need not be provided with passages for discharging water.

Although the present invention has been described with reference to preferred embodiments, workers skilled in the art will recognize that changes may be made in form and detail without departing from the spirit and scope of the invention.

What is claimed is:

1. A personal watercraft comprising:

a hull;

a deck attached to the hull forming a cockpit opening for an operator, the deck including an aperture proximate the cockpit opening; and a bilge pump comprising:

a pumping device secured within the hull and below the deck;

a pickup located within the hull and fluidly coupled to the pumping device;

an operating handle positioned proximate the cockpit opening and coupled to the pumping device to operate the pumping device, the operating handle extending through the aperture; and a locking device for holding the operating handle in a retracted position proximate the deck.

2. The personal watercraft of claim 1 wherein the operating handle includes a discharge opening and a passageway fluidly coupling the pumping device to the discharge opening.

3. The personal watercraft of claim 2 wherein the pumping device includes a housing forming a chamber for holding water, and a piston displaceable within the chamber to pump water through the passageway, the piston being connected to the operating handle for movement therewith.

4. The personal watercraft of claim 3 wherein the operating handle includes an end remote from the piston, the end having the discharge opening, and wherein the locking device retains the operating handle in a retracted position with the end adjacent the deck.

5. The personal watercraft of claim 1 wherein the locking device comprises engaging surfaces formed on an end of the operating handle engageable with complementary surfaces proximate the deck.

6. The personal watercraft of claim 5 wherein the engaging surfaces comprise at least one of flanges and threads.

7. The personal watercraft of claim 1 wherein the pumping device includes a piston coupled to the operating handle to move therewith, the piston being moveable in a housing, wherein the housing includes a discharge opening on an end proximate the locking device wherein water discharge is upon the deck.

8. The personal watercraft of claim 1 and further comprising a second locking device for holding the operating handle in the retracted position proximate the deck.

9. A hand operated bilge pump for a personal watercraft having a hull and a deck attached thereto, the deck having a cockpit opening for an operator, the bilge pump comprising:

a pumping device;

a pickup locatable within the hull and fluidly coupled to the pumping device;

a retractable operating handle coupled to the pumping device to operate the pumping device; and a locking device for holding the operating handle in a retracted position.

10. The hand operated bilge pump of claim 9 wherein the operating handle includes a discharge opening and a passageway fluidly coupling the pumping device to the discharge opening.

11. The hand operated bilge pump of claim 9 wherein the pumping device includes a piston coupled to the operating handle to move therewith, the piston being moveable in a housing, wherein the housing includes a discharge opening on an end proximate the locking device.

12. The hand operated bilge pump of claim 9 and further comprising an adapter for attaching the pumping device to the deck.

13. The hand operated bilge pump of claim 9 and further comprising a second locking device for holding the operating handle in the retracted position.

14. The hand operated bilge pump of claim 9 wherein the operating handle moves relative to a portion of the pumping device, the locking device comprising engaging flanges formed between the operating handle and the portion of the pumping device.

15. The hand operated bilge pump of claim 14 wherein the operating handle includes a grip, and wherein the portion comprises a recess adapted to receive the grip.

16. The hand operated bilge pump of claim 15 wherein the pumping device includes a discharge opening disposed in the portion opening to the recess.

17. The hand operated bilge pump of claim 16 wherein the operating handle extends through the discharge opening.

18. A hand operated bilge pump for a personal watercraft having a hull and a deck attached thereto, the bilge pump comprising:

a pumping device having a portion with a recess and a discharge opening disposed in the portion opening to the recess;

a pickup locatable within the hull and fluidly coupled to the pumping device; and a retractable operating handle extending through the discharge opening and coupled to the pumping device to operate the pumping device, the operating handle having a grip, wherein the recess is adapted to receive the grip when the handle is in a retracted position.

19. The hand operated bilge pump of claim 18 and further comprising a deflector to deflect water from the discharge opening to a surface forming the recess.

20. A personal watercraft comprising:

a hull;

a deck attached to the hull forming a cockpit opening for an operator; and a bilge pump comprising:

a pumping device having a portion with a recess and a discharge opening disposed in the portion opening to the recess;

a pickup locatable within the hull and fluidly coupled to the pumping device; and a retractable operating handle extending through the discharge opening and coupled to the pumping device to operate the pumping device, the operating handle having a grip, wherein the recess is adapted to receive the grip when the handle is in a retracted position such that the grip is proximate the deck.

21. A hand operated bilge pump for a personal watercraft having a hull and a deck attached thereto, the bilge pump comprising:

a pumping device having a discharge opening;

a pickup locatable within the hull and fluidly coupled to the pumping device; and a retractable operating handle coupled to the pumping device to operate the pumping device, the operating handle extending through the discharge opening.

22. A hand operated bilge pump for a personal watercraft having a hull and a deck attached thereto, the bilge pump comprising:

a pumping device;

an operating handle coupled to the pumping device to operate the pumping device;

a pickup fluidly coupled to the pumping device, the pickup having compliant means for engaging a portion of the personal watercraft to hold the pickup in place.

23. The hand operated bilge pump of claim 22 wherein the compliant means comprises a compliant pad.

* * * * *

UNITED STATES PATENT AND TRADEMARK OFFICE

CERTIFICATE OF CORRECTION

PATENT NO. : 5,950,555

DATED : September 14, 1999

INVENTOR(S) : Damask

It is certified that error appears in the above-identified patent and that said Letters Patent is hereby corrected as shown below:

Claim 15, line 2, after "portion" insert --of the pumping device--.

Claim 16, line 3, after "portion" insert --of the pumping device--.

Claim 22, line 6, after ";" insert --and--.

Signed and Sealed this

Twenty-sixth Day of September, 2000

*Attest:*

*Attesting Officer*

Q. TODD DICKINSON

*Director of Patents and Trademarks*